US009696069B2

(12) United States Patent
Liu et al.

(10) Patent No.: US 9,696,069 B2
(45) **Date of Patent: *Jul. 4, 2017**

(54) EJECTOR

(71) Applicant: Carrier Corporation, Jupiter, FL (US)

(72) Inventors: Hongsheng Liu, Shanghai (CN); Jiang Zou, Shengzhou (CN); Frederick J. Cogswell, Glastonbury, CT (US); Jinliang Wang, Ellington, CT (US); Parmesh Verma, South Windsor, CT (US)

(73) Assignee: Carrier Corporation, Jupiter, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/069,925

(22) Filed: Mar. 14, 2016

(65) Prior Publication Data

US 2016/0195316 A1 Jul. 7, 2016

Related U.S. Application Data

(62) Division of application No. 13/993,207, filed as application No. PCT/CN2011/000001 on Jan. 4, 2011, now Pat. No. 9,285,146.

(51) Int. Cl.
*B05B 17/04* (2006.01)
*F25B 41/00* (2006.01)
(Continued)

(52) U.S. Cl.
CPC ..... *F25B 41/00* (2013.01); *F04F 5/461* (2013.01); *F25B 49/02* (2013.01); *F25B 2341/0012* (2013.01); *F25B 2341/0013* (2013.01)

(58) Field of Classification Search
CPC .... F02M 59/00; F02M 61/168; F02M 47/027; F02M 61/18; F02M 51/0671;
(Continued)

(56) References Cited

U.S. PATENT DOCUMENTS 1,350,095 A 8/1920 Eddison
1,467,312 A 9/1923 Ewing et al.
(Continued)

FOREIGN PATENT DOCUMENTS

CN 1456851 A 11/2003
CN 1470821 A 1/2004
(Continued)

OTHER PUBLICATIONS

International Search Report and Written Opinion for PCT/CN2011/000001, dated Oct. 20, 2011.
(Continued)

*Primary Examiner* — Justin Jonaitis
(74) *Attorney, Agent, or Firm* — Bachman & LaPointe, P.C.

(57) ABSTRACT

An ejector has a primary inlet, a secondary inlet, and an outlet. A primary flowpath extends from the primary inlet to the outlet and a secondary flowpath extends from the secondary inlet to the outlet, merging with the primary flowpath. A motive nozzle surrounds the primary flowpath upstream of a junction with the secondary flowpath. The motive nozzle has a throat and an exit. In one group of embodiments, an effective area of the exit is variable. In others, the needle may extend downstream from a flow control portion or may have an upstream convergent surface of a flow control portion.

6 Claims, 5 Drawing Sheets

(51) Int. Cl.
*F04F 5/46* (2006.01)
*F25B 49/02* (2006.01)

(58) Field of Classification Search
CPC ..... F02M 61/0678; F02M 61/08; F02M 51/0603; F02M 61/10; A01G 25/023; B05B 1/3006; B05B 1/185; B05B 1/14; B05B 1/18; B05B 1/30; B05B 1/304; F25B 1/06; F25B 1/00; F25B 41/00; F25B 41/066
USPC ..... 239/11, 569, 583, 584, 585.5, 533.1, 239/533.2, 398, 407, 408, 416.4, 416.5, 239/417.3
See application file for complete search history.

(56) References Cited

U.S. PATENT DOCUMENTS 1,836,318 A 12/1931 Gay
3,277,660 A 10/1966 Kemper et al.
4,351,304 A * 9/1982 Schweizer ..... F02M 69/04 123/472
5,540,388 A * 7/1996 Sasao ..... F02M 51/0678 239/417.3
6,706,438 B2 * 3/2004 Sahoda ..... F04F 5/461 137/111
6,966,199 B2 * 11/2005 Takeuchi ..... F04F 5/461 62/500
7,823,400 B2 * 11/2010 Oshitani ..... F25B 41/00 417/168
7,883,026 B2 * 2/2011 Micheli ..... B05B 1/3431 239/296
2002/0022172 A1 2/2002 Sahoda et al.
2004/0089019 A1 * 5/2004 Kawamura ..... F04F 5/04 62/500
2013/0111935 A1 * 5/2013 Zou ..... F25B 9/06 62/117

FOREIGN PATENT DOCUMENTS

CN 1499158 A 5/2004
DE 705684 C 5/1941
DE 1000959 B 1/1957
FR 2376384 A1 7/1978
GB 430246 A 6/1935
JP 62206348 A 9/1987
JP 05312421 A 11/1993
JP 2003336915 A 11/2003
JP 2008303851 A 12/2008
JP 2009144608 A 7/2009
JP 2009144609 A 7/2009
NL 5352 C 11/1919

OTHER PUBLICATIONS

Chinese Office Action for Chinese Patent Application No. 201180064145.2, dated Nov. 4, 2014.
Chinese Office Action for Chinese Patent Application No. 201180064145.2, dated Jul. 16, 2015.
US Office Action for U.S. Appl. No. 13/993,207, dated Jul. 7, 2015.
European Search Report for EP Patent Application No. 11854812.2, dated Aug. 9, 2016.

* cited by examiner

EJECTOR

CROSS-REFERENCE TO RELATED APPLICATION

This is a divisional application of U.S. patent application Ser. No. 13/993,207, filed Jun. 11, 2013, now U.S. Pat. No. 9,285,146, entitled "Ejector", which is the U.S. national stage of PCT/CN11/00001, filed Jan. 4, 2011, the disclosure of which is incorporated by reference herein in its entirety as if set forth at length.

BACKGROUND

The present disclosure relates to refrigeration. More particularly, it relates to ejector refrigeration systems.

Earlier proposals for ejector refrigeration systems are found in U.S. Pat. No. 1,836,318 and U.S. Pat. No. 3,277,660. FIG. 1 shows one basic example of an ejector refrigeration system 20. The system includes a compressor 22 having an inlet (suction port) 24 and an outlet (discharge port) 26. The compressor and other system components are positioned along a refrigerant circuit or flowpath 27 and connected via various conduits (lines). A discharge line 28 extends from the outlet 26 to the inlet 32 of a heat exchanger (a heat rejection heat exchanger in a normal mode of system operation (e.g., a condenser or gas cooler)) 30. A line 36 extends from the outlet 34 of the heat rejection heat exchanger 30 to a primary inlet (liquid or supercritical or two-phase inlet) 40 of an ejector 38. The ejector 38 also has a secondary inlet (saturated or superheated vapor or two-phase inlet) 42 and an outlet 44. A line 46 extends from the ejector outlet 44 to an inlet 50 of a separator 48. The separator has a liquid outlet 52 and a gas outlet 54. A suction line 56 extends from the gas outlet 54 to the compressor suction port 24. The lines 28, 36, 46, 56, and components therebetween define a primary loop 60 of the refrigerant circuit 27. A secondary loop 62 of the refrigerant circuit 27 includes a heat exchanger 64 (in a normal operational mode being a heat absorption heat exchanger (e.g., evaporator)). The evaporator 64 includes an inlet 66 and an outlet 68 along the secondary loop 62 and expansion device 70 is positioned in a line 72 which extends between the separator liquid outlet 52 and the evaporator inlet 66. An ejector secondary inlet line 74 extends from the evaporator outlet 68 to the ejector secondary inlet 42.

In the normal mode of operation, gaseous refrigerant is drawn by the compressor 22 through the suction line 56 and inlet 24 and compressed and discharged from the discharge port 26 into the discharge line 28. In the heat rejection heat exchanger, the refrigerant loses/rejects heat to a heat transfer fluid (e.g., fan-forced air or water or other fluid). Cooled refrigerant exits the heat rejection heat exchanger via the outlet 34 and enters the ejector primary inlet 40 via the line 36.

The exemplary ejector 38 (FIG. 2) is formed as the combination of a motive (primary) nozzle 100 nested within an outer member 102. The primary inlet 40 is the inlet to the motive nozzle 100. The outlet 44 is the outlet of the outer member 102. The primary refrigerant flow 103 enters the inlet 40 and then passes into a convergent section 104 of the motive nozzle 100. It then passes through a throat section 106 and an expansion (divergent) section 108 through an outlet (exit) 110 of the motive nozzle 100. The motive nozzle 100 accelerates the flow 103 and decreases the pressure of the flow. The secondary inlet 42 forms an inlet of the outer member 102. The pressure reduction caused to the primary flow by the motive nozzle helps draw the secondary flow 112 into the outer member. The outer member includes a mixer having a convergent section 114 and an elongate throat or mixing section 116. The outer member also has a divergent section or diffuser 118 downstream of the elongate throat or mixing section 116. The motive nozzle outlet 110 is positioned within the convergent section 114. As the flow 103 exits the outlet 110, it begins to mix with the flow 112 with further mixing occurring through the mixing section 116 which provides a mixing zone. In operation, the primary flow 103 may typically be supercritical upon entering the ejector and subcritical upon exiting the motive nozzle. The secondary flow 112 is gaseous (or a mixture of gas with a smaller amount of liquid) upon entering the secondary inlet port 42. The resulting combined flow 120 is a liquid/vapor mixture and decelerates and recovers pressure in the diffuser 118 while remaining a mixture. Upon entering the separator, the flow 120 is separated back into the flows 103 and 112. The flow 103 passes as a gas through the compressor suction line as discussed above. The flow 112 passes as a liquid to the expansion valve 70. The flow 112 may be expanded by the valve 70 (e.g., to a low quality (two-phase with small amount of vapor)) and passed to the evaporator 64. Within the evaporator 64, the refrigerant absorbs heat from a heat transfer fluid (e.g., from a fan-forced air flow or water or other liquid) and is discharged from the outlet 68 to the line 74 as the aforementioned gas.

Use of an ejector serves to recover pressure/work. Work recovered from the expansion process is used to compress the gaseous refrigerant prior to entering the compressor. Accordingly, the pressure ratio of the compressor (and thus the power consumption) may be reduced for a given desired evaporator pressure. The quality of refrigerant entering the evaporator may also be reduced. Thus, the refrigeration effect per unit mass flow may be increased (relative to the non-ejector system). The distribution of fluid entering the evaporator is improved (thereby improving evaporator performance). Because the evaporator does not directly feed the compressor, the evaporator is not required to produce superheated refrigerant outflow. The use of an ejector cycle may thus allow reduction or elimination of the superheated zone of the evaporator. This may allow the evaporator to operate in a two-phase state which provides a higher heat transfer performance (e.g., facilitating reduction in the evaporator size for a given capability).

The exemplary ejector may be a fixed geometry ejector or may be a controllable ejector. FIG. 2 shows controllability provided by a needle valve 130 having a needle 132 and an actuator 134. The actuator 134 shifts a tip portion 136 of the needle into and out of the throat section 106 of the motive nozzle 100 to modulate flow through the motive nozzle and, in turn, the ejector overall. Exemplary actuators 134 are electric (e.g., solenoid or the like). The actuator 134 may be coupled to and controlled by a controller 140 which may receive user inputs from an input device 142 (e.g., switches, keyboard, or the like) and sensors (not shown). The controller 140 may be coupled to the actuator and other controllable system components (e.g., valves, the compressor motor, and the like) via control lines 144 (e.g., hardwired or wireless communication paths). The controller may include one or more: processors; memory (e.g., for storing program information for execution by the processor to perform the operational methods and for storing data used or generated by the program(s)); and hardware interface devices (e.g., ports) for interfacing with input/output devices and controllable system components.

SUMMARY

One aspect of the disclosure involves an ejector having a primary inlet, a secondary inlet, and an outlet. A primary flowpath extends from the primary inlet to the outlet and a secondary flowpath extends from the secondary inlet to the outlet, merging with the primary flowpath. A motive nozzle surrounds the primary flowpath upstream of a junction with the secondary flowpath. The motive nozzle has a throat and an exit. An effective area of the exit and/or of a mixer is variable.

In one or more embodiments of any of the other embodiments the means is means for simultaneously varying the effective area of the exit and an effective area of the throat.

In one or more embodiments of any of the other embodiments, the means comprises a needle mounted for reciprocal movement along the primary flowpath between a first position and a second position and, in at least one position, spanning at least from the throat to the exit.

Another aspect of the disclosure involves an ejector comprising: a primary inlet; a secondary inlet; an outlet; a primary flowpath from the primary inlet to the outlet; a secondary flowpath from the secondary inlet to the outlet; a motive nozzle surrounding the primary flowpath upstream of a junction with the secondary flowpath and having: a throat and an exit; and a needle mounted for reciprocal movement along the primary flowpath between a first position and a second position. The needle comprises: a flow control portion; and a shaft, extending from the flow control portion. An actuator is coupled to the shaft to move the needle between the first and second positions. The needle shaft extends downstream from the flow control portion along the primary flowpath and is positioned for varying an effective area of the exit over at least a portion of a range of motion.

In one or more embodiments of any of the other embodiments, the needle is a second needle, and the actuator is a second actuator. The ejector includes: a first needle mounted for reciprocal movement along the primary flowpath between a first position and a second position and comprising: a flow control portion; and a shaft, extending from the flow control portion. A first actuator is coupled to the shaft of the first needle to move the first needle between its first and second positions. The first needle's shaft extends upstream from the first needle's flow control portion along the primary flowpath.

In one or more embodiments of any of the other embodiments, the needle flow control portion is, at least along a first zone, upstream convergent.

Other aspects of the disclosure involve methods for operating the system.

The details of one or more embodiments are set forth in the accompanying drawings and the description below. Other features, objects, and advantages will be apparent from the description and drawings, and from the claims.

BRIEF DESCRIPTION OF THE DRAWINGS

Like reference numbers and designations in the various drawings indicate like elements.

DETAILED DESCRIPTION

As is discussed further below, in addition to or separately from controlling an effective area of the throat, an effective area of the motive nozzle exit may be varied/controlled. The area ratio of a nozzle such as that of an ejector is ratio of exit area to throat area. With a conventional controllable ejector, using the needle to reduce throat area causes an associated increase in area ratio. A fifty percent reduction in throat area would cause a doubling in area ratio. If the area ratio is too large, the supersonic flow will be overexpanded. This results in a loss of efficiency which can be in the range of 20%. Thus, with an ejector having a controllable throat area, adding exit area control allows for an at least partial compensation.

Figure 3:
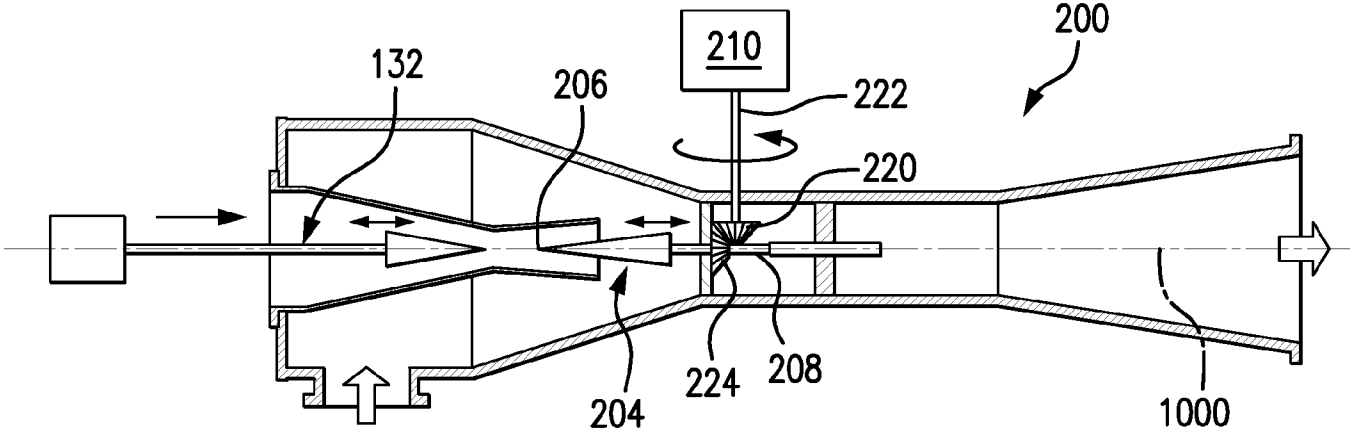
FIG. 3 is a schematic axial sectional view of an ejector.

FIG. 3 shows an ejector 200 which may be formed as a modification of the ejector 38 (either an actual modification or a design modification) and may be used in place thereof. An exemplary means for varying the effective area of the exit comprises a valve element (needle) which, along at least a portion of its range of motion, extends through the exit. A first exemplary such needle (exit needle) 204 is shown coaxial with the needle 132 (throat needle) along a centerline 1000 of the ejector. A needle 204 has a tip portion 206 opposite and facing the tip portion 136 of the needle 132. The needle 204 has a shaft 208 extending downstream from the tip. For moving the needle 204 to vary the effective area of the exit (e.g., the annular area between the needle and the inner surface of the motive nozzle at the exit or at a location close enough to the exit to produce the same or similar effect), an actuator 210 is coupled to the needle. Exemplary actuator 210 is a rotary actuator (e.g., a step motor). The exemplary actuator 210 is coupled to the needle valve via a geartrain. The exemplary geartrain includes a drive bevel gear 220 mounted to a shaft 222 of the actuator 210 to be driven thereby. Teeth of the drive bevel gear 220 are enmeshed with teeth of a driven bevel gear 224. The exemplary shaft 222 and its axis of rotation are orthogonal to and intersecting the needle shaft and the centerline of the ejector. Back and forth reciprocal rotation by the actuator 210 drives back and forth reciprocal translation of the needle 204. Although shown for ease of illustration as conical tip protuberances, the tips may be other than conical and may have similar maximum diameter to an adjacent portion of the shaft an may have known or yet-developed profiles.

Figure 3A:
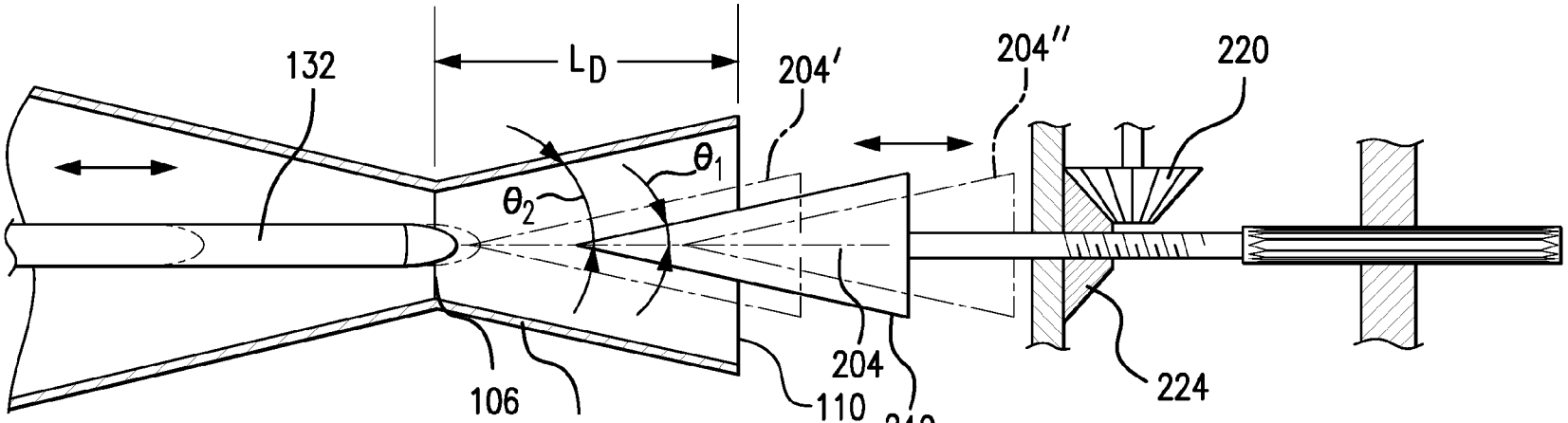
FIG. 3A is an enlarged view of a portion of the ejector of FIG. 3.

The exemplary needle 204 has a downstream divergent tapering portion 240 (FIG. 3A). The exemplary range of motion extends from a maximally inserted/extended condition/position 204' to a maximally withdrawn/retracted condition/position 204". An exemplary range of motion is at least 25% of the divergent length $L_D$ of the motive nozzle, more narrowly, 75-95%. Along at least a portion of this range of motion, the tapering portion is axially aligned with the exit so that insertion of the needle decreases the effective exit area (e.g., as approximated by the cross-sectional area of the annular space/gap between the exit and the portion 240). Similarly, retraction increases the effective exit area. The exemplary expansion (divergent) section 108 is shown having a characteristic half angle $\theta_2$. The exemplary portion 240 is shown having an exemplary half angle $\theta_1$. In the example, $\theta_2$ is constant so that the expansion section 108 is conical. Similarly, at least over some part of the tapering portion 240, $\theta_1$ is constant to define a frustum of a cone. If based on an existing ejector or its motive nozzle, the angles and dimensions of the ejector and/or nozzle may be preserved. Exemplary $\theta_1$ for such configuration is 0-30°, more narrowly 0-10°, or 2-10°, or 5-10°. Similarly exemplary $\theta_2$ is 0-30°, more narrowly 0-10°, or 2-10°, or 5-10°. Other nozzle profiles including non-uniform angles $\theta_1$. and $\theta_2$ are possible.

By way of example, the effective exit cross-sectional area reduction between the min and max conditions may be at least 5% of the max condition, more narrowly, at least 10% or 10-40%. These may be smaller than associate throat area reductions.

Figure 4:
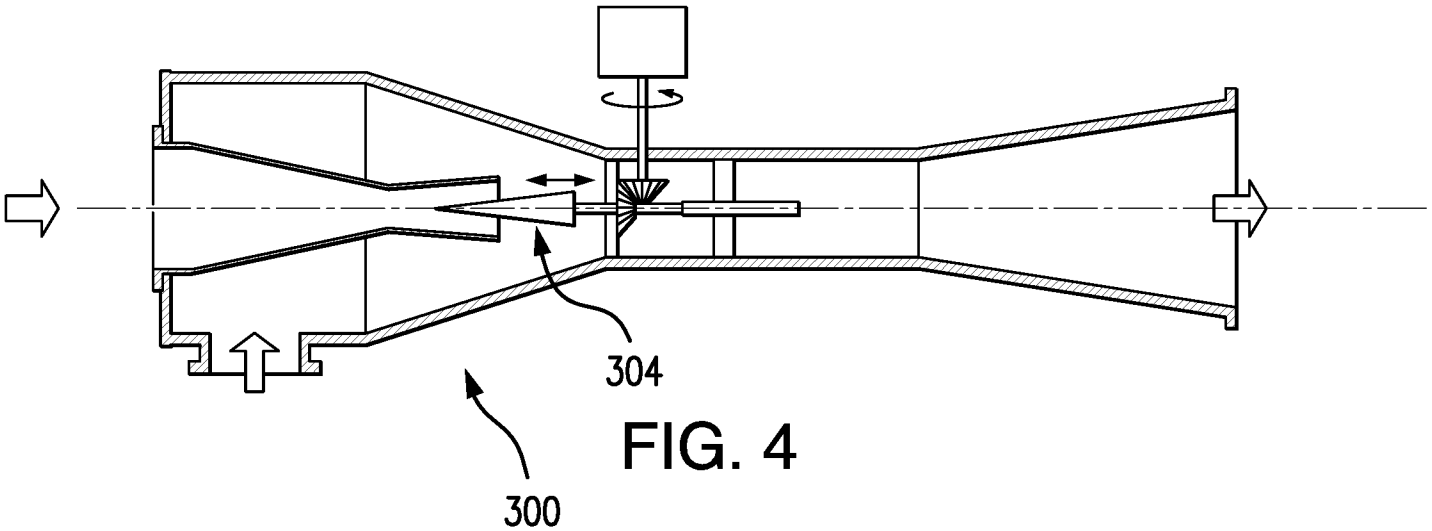
FIG. 4 is schematic axial sectional view of a second ejector.
Figure 4A:
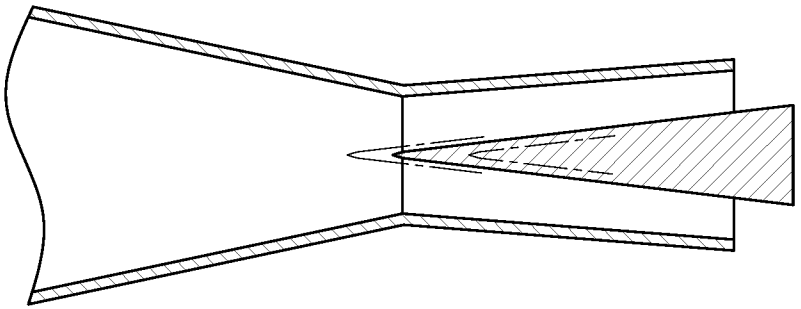
FIG. 4A is an enlarged partial view of the ejector of FIG. 3.

FIGS. 4 and 4A show a single-needle ejector 300 which may be otherwise similar to the ejector 200 but which lacks the needle 132 and associated actuator, etc. Instead, the proportions of the needle 304 and the motive nozzle are such that, at least along a portion of the range of motion of the needle, the needle extends into the throat and spans a distance from the throat to the exit. Along at least this portion of the range of motion, the needle controls both the effective throat area and the effective exit area.

Figure 5:
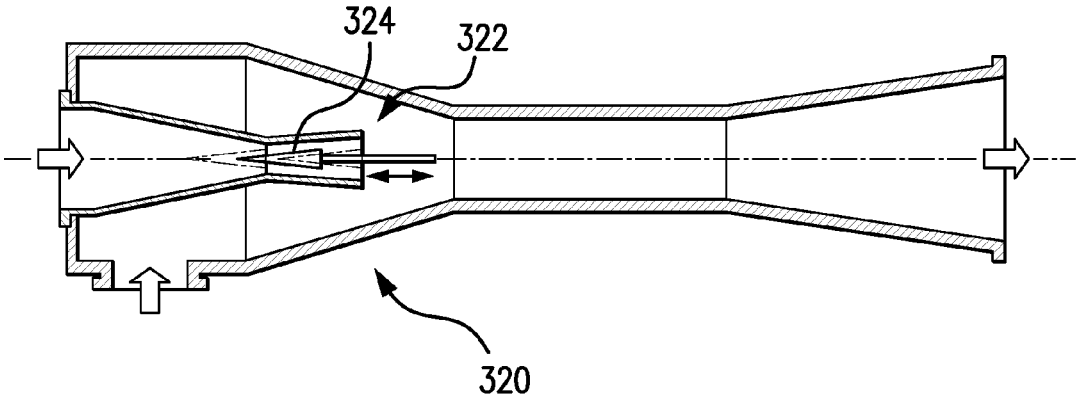
FIG. 5 is a schematic axial sectional view of a third ejector.
Figure 6:
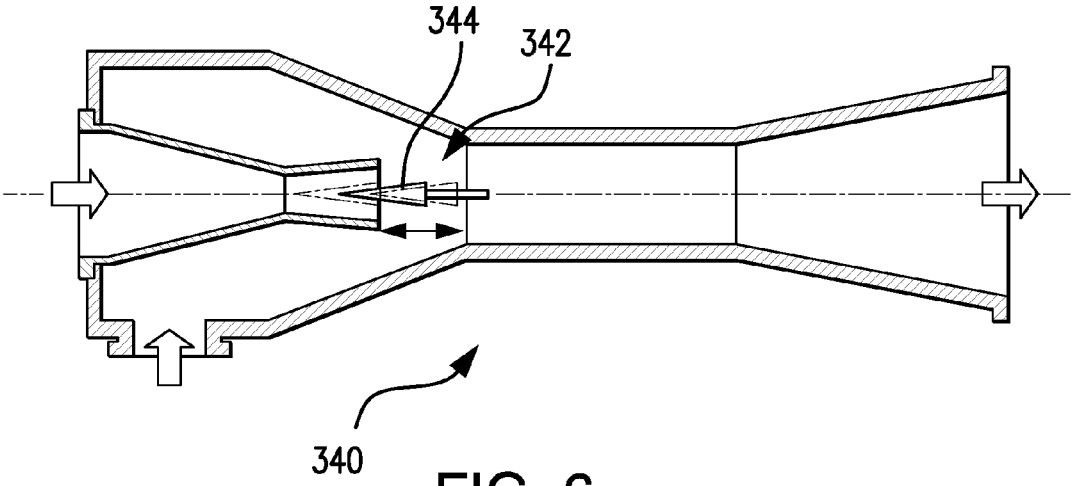
FIG. 6 is a schematic axial sectional view of a fourth ejector.

FIG. 5 shows an ejector 320 which may be otherwise similar but having a needle 322 which, along at least a portion of its range of motion, controls only an effective area of the throat and not the exit (e.g., by having the tapering portion end ahead of the exit). This may be achieved by a narrower and/or relatively short tapering portion 324. An exemplary control over the throat area may have a similar range as the aforementioned control over exit area. For example, a difference in area between min throat and max throat conditions may be at least 10% of the max throat condition area, more narrowly, at least 20% or 35-100%. FIG. 6 shows an ejector 340 wherein only the exit area is controlled by a needle 342 having a shorter, broader tapering portion 344 positioned to control only exit area and not throat area.

Figure 7:
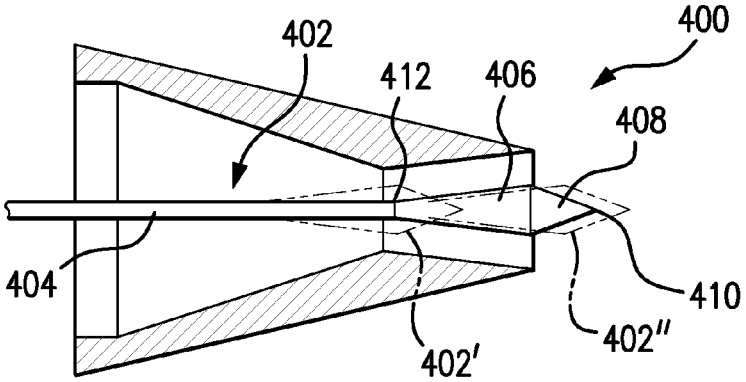
FIG. 7 is a partial schematic axial sectional view of a fifth ejector.

As a further alternative, a single needle may be actuated from upstream but extend through the motive nozzle throat so as to control effective properties of the divergent section 108 and the exit 110. FIG. 7 shows a motive nozzle of an ejector 400 which may be otherwise similar to the ejector 38 but with a different needle. The exemplary needle 402 has a relatively narrow upstream portion 404 which forms a main body of the needle. Downstream of the upstream portion 404 is a divergent (downstream divergent) portion 406. Downstream of divergent portion 406 is a convergent (downstream convergent) portion 408 which extends to a downstream tip 410. FIG. 7 also shows a range of motion between an upstream-most maximally retracted position 402' and a downstream-most maximally extended position 402". It can be seen that, over some portions of the range of motion, the needle 402 controls both the effective throat area (e.g., the area of the annular space between the throat 106 and the needle) and the effective exit area. The exemplary divergent portion 406 has a half angle which may have the same magnitude as $\theta_1$. The narrow portion of the needle at the upstream end 412 of the tapering portion (which forms a junction with the straight portion) may have a diameter less than 75% (more narrowly less than 50%) of the maximum needle diameter (e.g., the diameter at the junction 414 between 408 and 406), with a lower boundary limited by strength of material (e.g., of the stainless steel used in needles). This may also be less than 50% of the throat diameter, more narrowly less than 25%. An exemplary such configuration is estimated to eliminate a quarter to three quarters of the losses associated with throat control.

Figure 8:
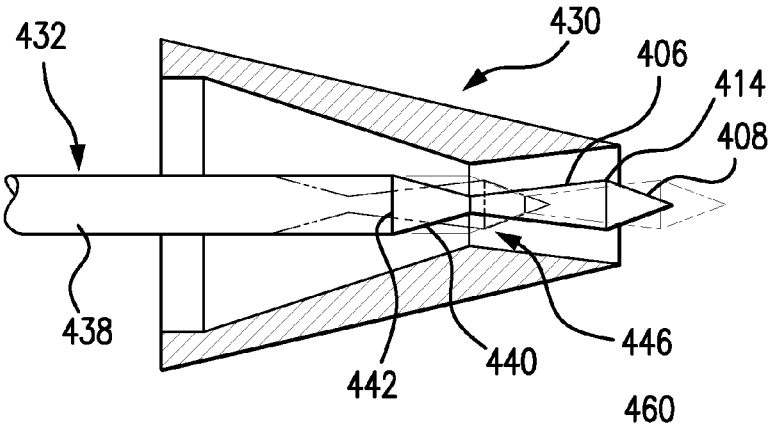
FIG. 8 is a partial schematic axial sectional view of a sixth ejector.

FIG. 8 shows motive nozzle of an ejector 430 which may be otherwise similar to the ejector 38 or the ejector 400. For example, relative to ejector 38, the ejector 430 may add similar divergent and convergent portions 406 and 408 to its needle 432, respectively, as does the ejector 400 while retaining a relatively broader proximal main shaft portion 438. The needle (shown with broken line illustrations of a retracted condition and an extended condition) has a convergently downstream tapering portion (downstream convergent) 440 extending downstream from a junction 442 with the shaft portion 438 to a junction 446 with the portion 406. This junction 446 establishes a local waist in the needle. The local waist may be, in at least part of the range of motion, near the throat 106. With the exemplary arrangement, retraction from the solid line position may have a similar effect to retraction of the needle of FIG. 7 on both effective throat and exit areas. However, a further insertion also has the same effect on exit area as in FIG. 7 but tends to reduce effective throat area as a greater proportion of the throat is occupied by the portion 440. In an exemplary redesign from a convention needle, the tapering portion 440 may be preserved from near the tip of the baseline needle. An exemplary half angle of taper is about 5°, more broadly 2-15°. A minimum diameter at the neck/junction 446 between the portions 440 and 406 is may correspond to that of the end 412 of FIG. 7.

Figure 9:
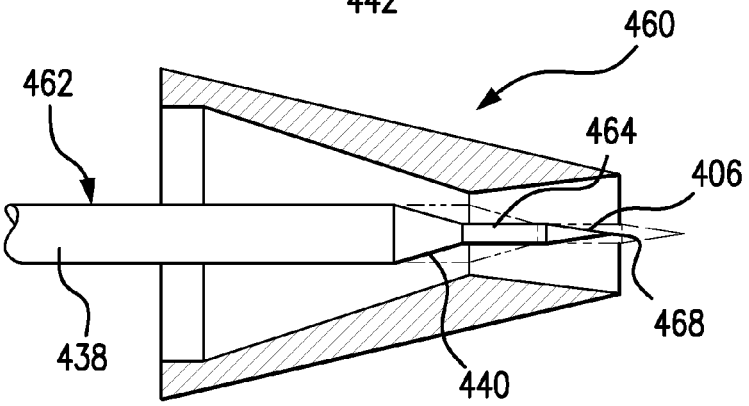
FIG. 9 is a partial schematic axial sectional view of a seventh ejector.

FIG. 9 shows another modification in a motive nozzle of an ejector 456 wherein the FIG. 8 protuberance is replaced in a needle 462 (shown retracted but with a broken line illustration of an extended condition) by a relatively narrow counterpart including a proximal portion 464 extending from the tapering portion 440 to create a stepped axial cross-section. A distal tapering portion 466 extends to a tip 468. Over much of its range of motion, with the portion 464 at the exit, there will be little effect on the effective exit area. However, with retraction, the tapering portion 466 will pass through the exit occupying lesser and lesser fractions of the exit and thereby increasing effective exit area. A diameter of the portion 466 may be similar to that of the junctions 412, 446. Length of the portion 464 may be effective to provide simultaneous control of throat and exit areas along at least part of its range of motion.

Figure 10:
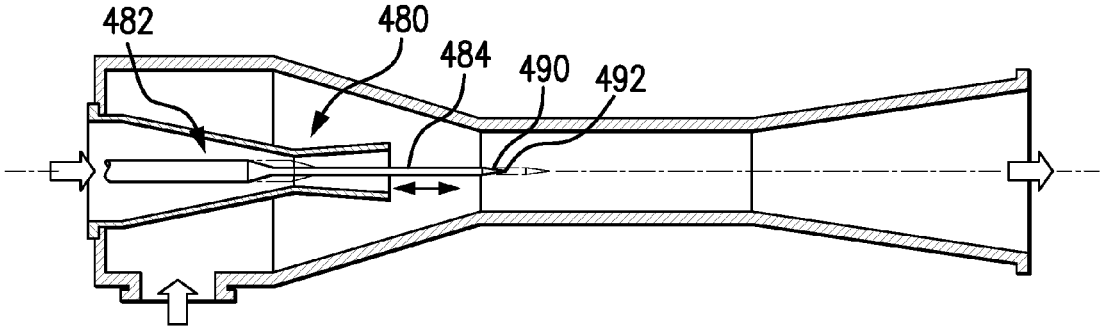
FIG. 10 is a schematic axial sectional view of an eighth ejector.

FIG. 10 shows an ejector 480 otherwise similar to the ejector 460 but having a needle 482 relatively longer intermediate portion 484. A distal/downstream tapering portion 490 of the needle, tapering from the intermediate portion 484 to the tip 492 is positioned to control an effective area of the mixer during at least a portion of the range of motion of the needle. The mixer may be oversized when the nozzle areas are reduced. With the needle tip 492 penetrating into the mixer constant area portion, the flow area of the mixer also is reduced to at least partially compensate for reduced total flow. The needle intermediate portion 484 and tip 492 may induce shocks in the mixer and avoid shocks occurring in the diffuser.

The ejectors may be fabricated from conventional components using conventional techniques appropriate for the particular intended uses.

Figure 1:
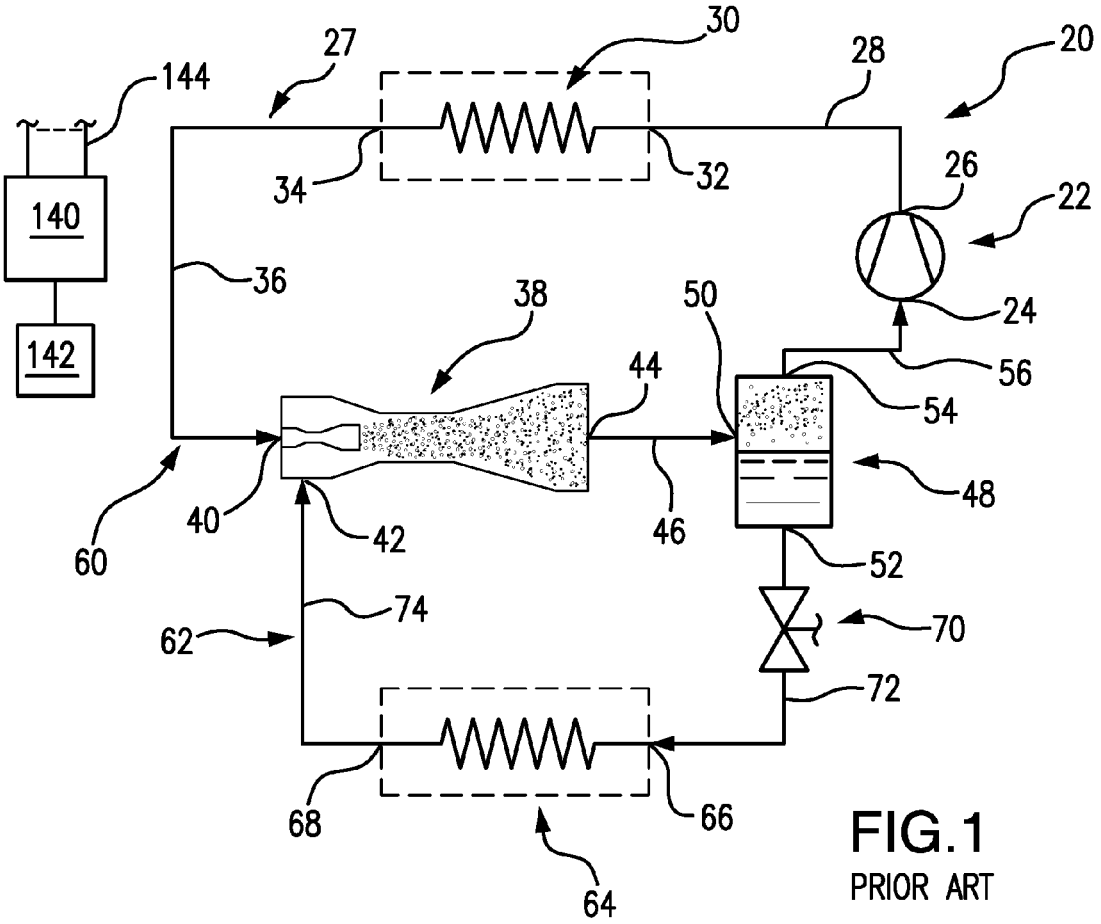
FIG.1 PRIOR ART
FIG. 1 is a schematic view of a prior art ejector refrigeration system.
Figure 2:
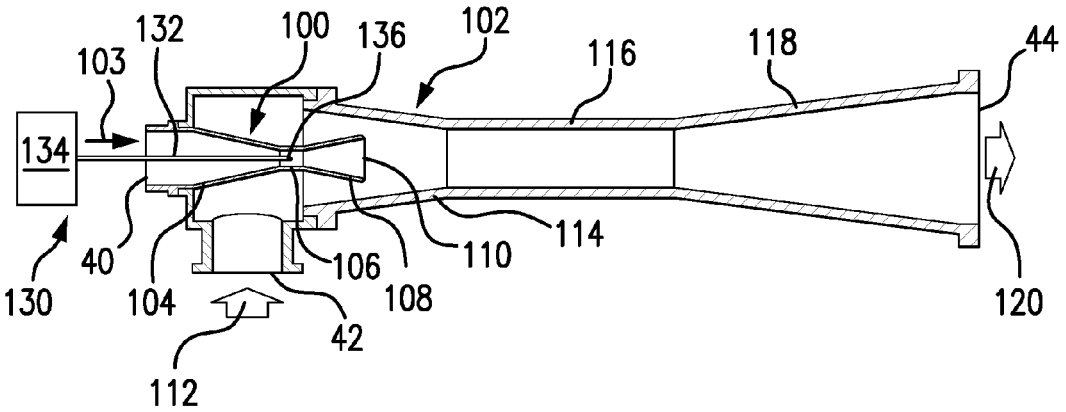
FIG. 2 PRIOR ART
FIG. 2 is an axial sectional view of a prior art ejector.

A controllable ejector, such as shown in FIG. 2, is generally used to control the high-side pressure (e.g., in a baseline system or in modifications herein). The high-side pressure is the refrigerant pressure that exists from the compressor exit 26 to the ejector inlet 40. For transcritical cycles such as $CO_2$, raising the high side pressure decreases the enthalpy out of the gas cooler and increases the cooling available for a given compressor mass flow rate. However, increasing the high side pressure also increases the compressor power. There is an optimum pressure value that maximizes the system efficiency at a given operating condition. Generally, this target value varies with the refrigerant temperature leaving the gas cooler. A high side pressure-temperature curve may be programmed in the controller. To raise the high-side pressure the throat area 106 is reduced. The controller does this by moving the needle 132 into the throat (to the right in FIG. 2).

For the FIG. 3 embodiment, there are two independent actuators which may be varied by the controller 140. The upstream needle 132 would be controlled in the same way as the traditional ejector needle in FIG. 2; that is, it would be used to control the high-side pressure. The downstream needle 204 is varied to control the area expansion ratio of the motive nozzle. The expansion ratio can be defined as the ratio of the exit area of the motive nozzle (at 110) divided by the throat (or other minimum) area of the motive nozzle (at 106). For a given system operating condition there is an optimum expansion ratio. Increasing the expansion ratio increases the depressurization of the refrigerant that occurs in the motive nozzle. Generally it is desirable, for optimum ejector efficiency, to depressurize the motive flow to a value that is similar to the pressure at the suction port 42. As needle 132 is inserted into the throat (moves to the right) to raise the high-side pressure, the area ratio increases. To maintain the same area ratio, needle 204 is moved toward the throat (to the left).

It may also be desirable to vary the expansion ratio while holding needle 132 constant if the system operating conditions change. For example, if the system 20 is a container refrigeration system, then there may be several different cold-air set points. If the cold-air set point, is lowered then the evaporator 64 pressure will decrease. To optimize the ejector performance it may be desirable to increase the area ratio in order to lower the pressure of the refrigerant leaving the motive nozzle. To do this controller 140 may further insert needle 204 into the motive nozzle.

FIGS. 4-6 have a single downstream needle 304, and FIGS. 7-10 have a single upstream needle. The primary function of such needle is to vary the throat size to control the high-side pressure. By doing so it also varies the exit area. The area ratio as a function of throat size is predesigned by the needle and motive nozzle geometry. The needle of FIG. 8 may reduce the throat size either by moving to the right (downstream) or to the left (upstream) from the maximum throat area position. In this way, the change in area ratio with throat size will be different depending on which way the needle is moved. Therefore the controller may choose between two different area ratios for a given throat area. For example, if the throat is being reduced from the max. throat condition due to reduced load, the larger of two available area ratios may be chosen when there is a large overall pressure ratio (between gas cooler and evaporator) and the smaller area ratio may be chosen when there is a smaller overall pressure ratio.

The controller may estimate the pressure at the motive nozzle exit based on models and on the motive nozzle inlet conditions (measured pressure and temperature along line 36). The suction port pressure (along line 74) may also be measured. The controller may use this information to determine the desired area ratio.

Although embodiments are described above in detail, such description is not intended for limiting the scope of the present disclosure. It will be understood that various modifications may be made without departing from the spirit and scope of the disclosure. For example, when implemented in the remanufacturing of an existing system or the reengineering of an existing system configuration, details of the existing configuration may influence or dictate details of any particular implementation. Accordingly, other embodiments are within the scope of the following claims.

What is claimed is:

1. A refrigeration system comprising:
a refrigerant compressor along a refrigerant flowpath;
a first heat exchanger and a second heat exchanger along the refrigerant flowpath
an ejector along the refrigerant flowpath, said ejector comprising:
a primary inlet;
a secondary inlet;
an outlet;
a primary flowpath from the primary inlet to the outlet;
a secondary flowpath from the secondary inlet to the outlet;
a motive nozzle surrounding the primary flowpath upstream of a junction with the secondary flowpath and having:
a throat; and
an exit; and
means for simultaneously varying an effective area of the exit and an effective area of the throat.

2. The refrigeration system of claim 1 wherein:
the motive nozzle has a convergent section extending downstream to the throat and a divergent section extending from the throat to the exit.

3. The refrigeration system of claim 1 wherein:
the means comprises a needle mounted for reciprocal movement along the primary flowpath between a first position and a second position and, in at least one position, spanning at least from the throat to the exit.

4. An ejector comprising:
a primary inlet;
a secondary inlet;
an outlet;
a primary flowpath from the primary inlet to the outlet;
a secondary flowpath from the secondary inlet to the outlet;
a motive nozzle surrounding the primary flowpath upstream of a junction with the secondary flowpath and having:
a throat; and
an exit; and
a needle mounted for reciprocal movement along the primary flowpath between a first position and a second position and comprising:
a flow control portion; and
a shaft, extending from the flow control portion; and
an actuator coupled to the shaft to move the needle between the first and second positions,
wherein:
the needle shaft extends downstream from the flow control portion along the primary flowpath and is positioned for varying an effective area of the exit over at least a portion of a range of motion;

the needle is a second needle, and the actuator is a second actuator; and the ejector includes:

a first needle mounted for reciprocal movement along the primary flowpath between a first position and a second position and comprising:

a flow control portion; and a shaft, extending from the flow control portion; and a first actuator coupled to the shaft of the first needle to move the first needle between its first and second positions, wherein the first needle's shaft extends upstream from the first needle's flow control portion along the primary flowpath.

5. The ejector of claim 4 wherein the needle flow control portion is, at least along a first zone, upstream convergent.

6. The ejector of claim 4 wherein:

the motive nozzle has a convergent section extending downstream to the throat and a divergent section extending from the throat to the exit.

* * * * *